US008115565B2

(12) United States Patent
Ligander et al.

(10) Patent No.: US 8,115,565 B2
(45) Date of Patent: Feb. 14, 2012

(54) DUAL POLARIZED WAVEGUIDE FEED ARRANGEMENT WITH SYMMETRICALLY TAPERED STRUCTURES

(75) Inventors: Per Ligander, Göteborg (SE); Lars Josefsson, Askim (SE); Bengt Svensson, Mölndal (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 204 days.

(21) Appl. No.: 12/520,709

(22) PCT Filed: Dec. 21, 2006

(86) PCT No.: PCT/SE2006/050615

§ 371 (c)(1), (2), (4) Date: Jun. 22, 2009

(87) PCT Pub. No.: WO2008/076029

PCT Pub. Date: Jun. 26, 2008

(65) Prior Publication Data

US 2009/0295511 A1 Dec. 3, 2009

(51) Int. Cl.
*H01P 1/165* (2006.01)

(52) U.S. Cl. ..... 333/21 A; 333/26; 333/34

(58) Field of Classification Search ..... 333/21 A, 333/137, 26, 34

See application file for complete search history.

(56) References Cited

U.S. PATENT DOCUMENTS

| | | | | |
|---|---|---|---|---|
| 5,422,611 | A * | 6/1995 | Kashima et al. | 333/137 |
| 5,600,286 | A | 2/1997 | Livingston et al. | |
| 5,737,698 | A * | 4/1998 | Gabrelian et al. | 455/286 |
| 6,445,260 | B1 * | 9/2002 | Miyazaki et al. | 333/21 A |
| 2002/0171503 | A1 | 11/2002 | Ohtani et al. | |
| 2005/0140461 | A1 * | 6/2005 | Baird et al. | 333/21 A |

FOREIGN PATENT DOCUMENTS

JP 2005-039414 A 2/2005

* cited by examiner

*Primary Examiner* — Benny Lee

(57) ABSTRACT

A waveguide arrangement having a longitudinal extension, along which an electromagnetic wave may propagate, and comprising at least one waveguide part and a feeding arrangement which is arranged for feeding said waveguide part with a first polarization and a second polarization, said polarizations being mutually orthogonal. The feeding arrangement comprises a dielectric carrier material comprising a first feeding conductor, feeding the first polarization and a second feeding conductor, feeding the second polarization, where the first polarization is excited by means of first excitation means fed by said first feeding conductor and the second polarization is excited by means of second excitation means fed by said second feeding conductor, where at least one excitation means is a symmetrical structure with respect to the longitudinal extension.

13 Claims, 7 Drawing Sheets

A-A

DUAL POLARIZED WAVEGUIDE FEED ARRANGEMENT WITH SYMMETRICALLY TAPERED STRUCTURES

TECHNICAL FIELD

The present invention relates to a waveguide arrangement having a longitudinal extension, along which an electromagnetic wave may propagate, and comprising at least one waveguide part and a feeding arrangement, where the feeding arrangement is arranged for feeding the waveguide part with a first polarization and a second polarization, said polarizations being mutually orthogonal.

BACKGROUND

When designing microwave circuits, waveguides are often used due to their low loss. It is often preferable to excite a rectangular waveguide in two polarizations, normally two orthogonal polarizations. Today, this is achieved by using two probes that penetrate the waveguide from two orthogonal directions, where the probes in turn may be connected to suitable connectors on the outside of the waveguide. These arrangements use a lot of components, and are thus very costly.

A typical application for a dual polarized waveguide is within an active electronically scanned array antenna (AESA). Such an antenna comprises a large number of radiating antenna elements, and thus the dual polarized feeding arrangements of today become very expensive, since there are many free-standing components that have to be assembled. Many components that have to be assembled also give rise to problems regarding tolerances which also affect the costs negatively.

There is thus a need for finding a simple and low-cost dual polarized waveguide feed arrangement, which is possible to integrate with existing active T/R-modules (Transmit/Receive).

SUMMARY OF THE INVENTION

The object of the present invention is to provide a dual polarized waveguide feed arrangement that is simpler and less costly than the previously known dual polarized waveguide feed arrangement.

This problem is solved by means of a waveguide arrangement as mentioned initially. Furthermore, the feeding arrangement comprises a dielectric carrier material having a first main side and a second main side with metalization patterns formed on the sides, where the metalizations comprise a first feeding conductor, feeding the first polarization and a second feeding conductor, feeding the second polarization. The first polarization is excited by means of first excitation means fed by the first feeding conductor and the second polarization is excited by means of second excitation means fed by the second feeding conductor, where at least one excitation means is a symmetrical structure with respect to the longitudinal extension.

According to a preferred embodiment, the waveguide arrangement comprises a first waveguide part, which first waveguide part comprises a first wall, a second wall, a third wall, a fourth wall, and a longitudinal opening, where the first wall, the second wall, and the third wall essentially form a U-formed wall structure, where the fourth wall constitutes a roof on the top of the first wall, the second wall, and the third wall, electrically connecting them, where the roof is essentially parallel to, and facing away from, the dielectric carrier material, when the waveguide part is mounted to the dielectric carrier material, where furthermore the first excitation means comprises a first structure that extends from the fourth wall, and also extends in the longitudinal extension, where the first structure tapers towards the first feeding conductor, orthogonal to the first main side, and makes electrical contact with the first feeding conductor.

According to another preferred embodiment, the waveguide arrangement comprises a second waveguide part, similar to the first waveguide part, where the first waveguide part and the second waveguide part are mounted opposite each other is such a way that they together form a total waveguide part with the dielectric carrier material positioned between the waveguide parts, and where the first excitation means also comprises a second structure which extends from the second waveguide part, and extends longitudinally, orthogonal to the first main side, where the second structure extends towards the first feeding conductor, and makes electrical contact with the first feeding conductor.

According to another preferred embodiment, the first waveguide part and the second waveguide part are formed integrally, constituting an integral waveguide part having a first side, a second side, a third side and a fourth side, where the first side and the third side are opposite each other, and each one of these sides is supplied with a respective first longitudinal slot and second longitudinal slot formed on the middle of the opposing surfaces of the first side and the third side, the slots being arranged for insertion of the dielectric carrier material.

According to another preferred embodiment, the second excitation means comprises at least one pair of tapered structures which extend in the longitudinal extension, each taper being essentially orthogonal to the taper of the first excitation means, where the two tapered structures in the pair are symmetrical with respect to a symmetry line that extends in the longitudinal extension and equally divides the first main side of the dielectric carrier material into two parts, the two tapered structures being placed opposite each other, each taper being directed away from the feeding arrangement.

According to another preferred embodiment, the tapered structures are made as etched structures being connected to a surrounding ground plane structure, both being a part of the metalization pattern on the first main side, which etched structures extend in the longitudinal extension and taper towards the surrounding ground plane structure.

According to another preferred embodiment, each one of the tapered structures comprises a wall structure extending perpendicular to the first main side, where each wall structure has an outer contour which corresponds to the tapered structure, the wall structure being fed by the second conductor. The wall structure may be formed integrally with the fourth wall of the first waveguide part.

According to another preferred embodiment, the second excitation means is fed by the second feeding conductor by means of electromagnetic coupling.

Other preferred embodiments are evident from the dependent claims

A number of advantages are provided by the present invention. For example:

- A low loss system is obtained, since the present invention may be used integrated with a T/R-module.
- Since there are no connectors between a T/R-module and radiating elements, size, loss and cost are reduced.
- The absence of connectors eliminates connector contact problems
- Microwave components may be placed inside the waveguide, being protected from the surroundings.

BRIEF DESCRIPTION OF DRAWINGS

The present invention will now be described more in detail with reference to the appended drawings, where.

DETAILED DESCRIPTION OF THE INVENTION

Figure 1:
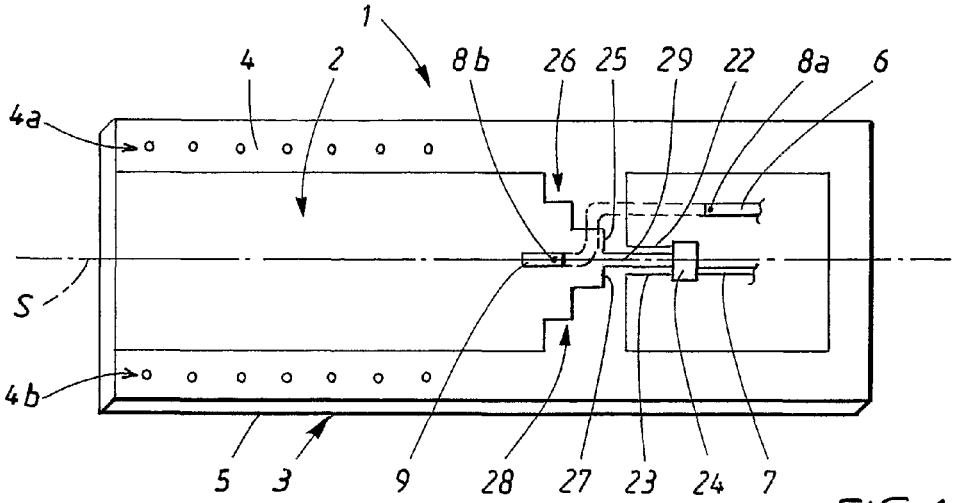
FIG. 1 shows a top view of a dielectric carrier material according to a first embodiment of the present invention.

In FIG. 1, showing a first embodiment example of the present invention, a dielectric carrier material 1 is shown, having a first main side 2 and a second main side 3, originally having a metallic copper cladding on both main sides 2, 3. The copper on the first and second main sides is generally used as a respective first ground plane 4 and second ground plane 5, but is etched away to such an extent that desired copper patterns are formed on the respective main sides 2, 3.

The first ground plane 4 mainly constitutes a frame structure which is connected to the second ground plane by means of vias 4*a*, 4*b*. These vias 4*a*, 4*b* are shown in corresponding figures throughout the description, but are not commented further. The number of vias and their placing is of course optional, and it is conceivable that there are no vias there at all.

The second ground plane 5 mainly covers the second main side 3 except for the portions where feeding conductors run. The first main side 2 of the dielectric carrier material 1 has a longitudinal extension, which is divided equally into two parts by a symmetry line S.

On the first main side 2 of the dielectric carrier 1, there is a first feeding conductor 6 and a second feeding conductor 7, where the feeding conductors 6, 7 are arranged to feed a respective polarization in a surface-mountable waveguide part (not shown in FIG. 1). The origin of the feeding conductors is not shown in FIG. 1, as many forms of suitable transmitting and/or receiving devices are conceivable, and are well known in the art. The first conductor 6 is partly formed on the second main side 3, due to crossing metallization patterns on the first main side 2. The transitions between the main sides 2, 3 are achieved by means of vias 8*a*, 8*b*. The first feeding conductor 6 ends in a feeding pad 9, being transferred from the second main side by means of a via 8*a*.

Figure 2A:
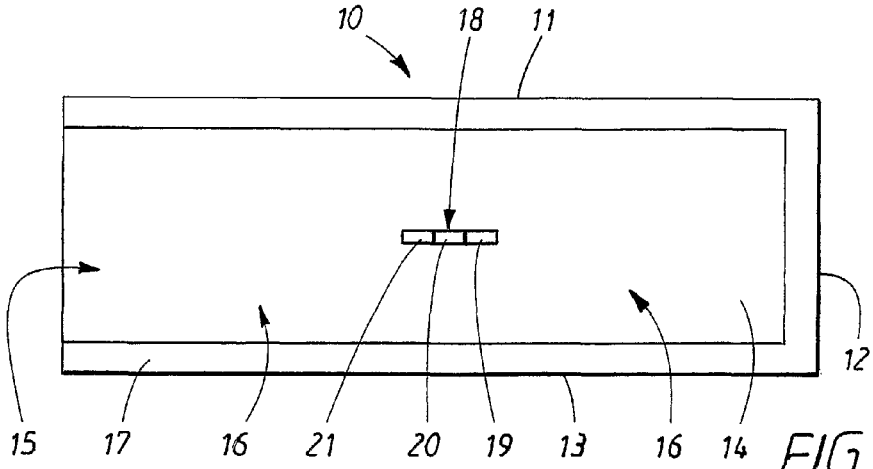
FIG. 2*a* shows a bottom view of a waveguide part according to a first embodiment of the present invention.
Figure 2B:
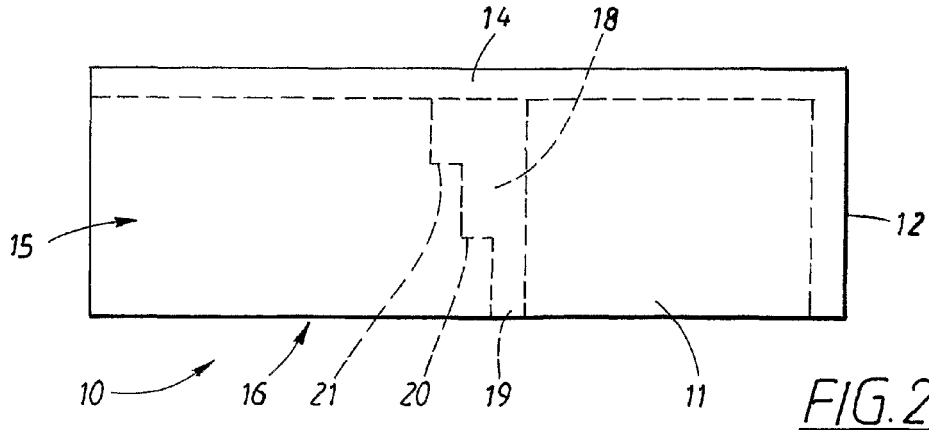
FIG. 2*b* shows a side view of a waveguide part according to a first embodiment of the present invention.

A surface-mountable waveguide part 10, as shown in FIGS. 2*a* and 2*b*, comprises a first wall 11, a second wall 12, a third wall 13 (FIG. 2*a*), a fourth wall 14, an open side 15 and an longitudinal opening 16. The first three walls 11, 12, 13, essentially form a U-formed wall structure, where the fourth wall 14 constitutes a roof on the top of the first three walls 11, 12, 13, connecting them. The roof 14 is essentially parallel to, and facing away from, the dielectric carrier material 1, when the waveguide part 10 is mounted to the dielectric carrier material 1.

Figure 3:
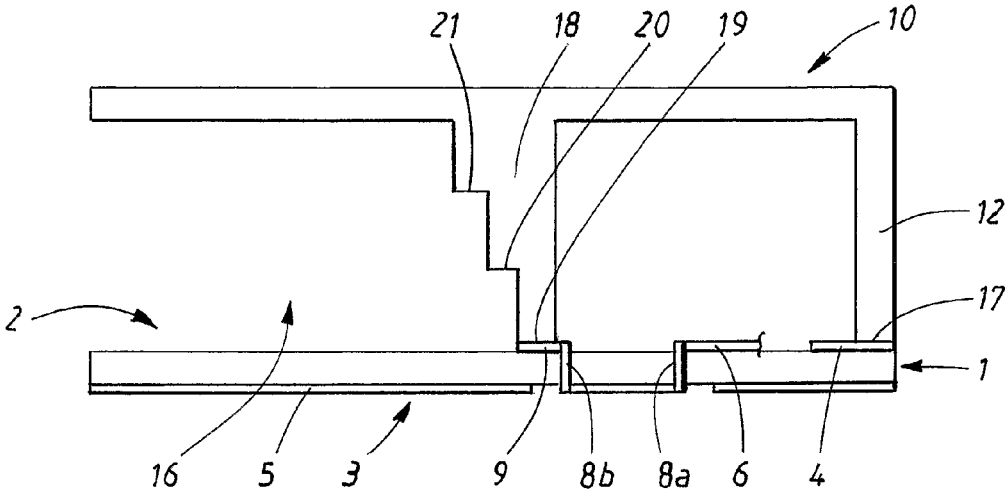
FIG. 3 shows a side view in the form of a central "slice" of the waveguide part in FIG. 2*a* and FIG. 2*b* mounted to the dielectric carrier material in FIG. 1.

FIG. 3 shows a longitudinal cross-sectional "slice" of the surface-mounted wave-guide part 10 when it is mounted on the first main side 2 of the dielectric carrier material 1. The slice is shown along the symmetry line S of FIG. 1. The ground plane 5 on the second main side 3 partly serves as a remaining fifth wall of the surface-mounted waveguide part 10, thus closing the longitudinal opening 16. The dielectric carrier material 1 and the surface-mounted waveguide part 10 together form an integral dual polarized waveguide with feed. The ground plane 4 on the first main side 2, as shown in FIG. 1, partly comprises a solderable area corresponding to a solderable contact area 17 on the waveguide part 10.

With reference to FIG. 2*a*, FIG. 2*b* and FIG. 3, the transition from the first feeding conductor 6 (FIG. 3) to the surface-mounted waveguide part 10 is formed as a stepped structure 18 having a height perpendicular to the main extension of the fourth wall 14 (FIGS. 2*a*, 2*b*) and a width that corresponds to the width of the first feeding conductor 6. The stepped structure 18 has a contact part 19 that is arranged to be in the same level as the feeding pad 9 (FIG. 3) of the first feeding conductor 6 (FIG. 3) when the waveguide part 10 is mounted to the dielectric carrier 1.

The contact part 19 is arranged for being soldered to the feeding pad 9. The rest of the first stepped structure 18 forms steps 20, 21 that lead towards the fourth wall 14 of the waveguide part 10, and is preferably formed integrally with the waveguide part 10. Such a transition is well-known in the art, and will not be discussed more in detail here.

Referring to FIG. 1, the second feeding conductor 7 is divided into two parts, a first sub-conductor 22 and a second sub-conductor 23, by means of a power divider 24 which also acts as a 180° phase shifter. The second feeding conductor 7 is thus divided equally between the first sub-conductor 22 and the second sub-conductor 23, where there a phase difference of 180° is introduced between the first sub-conductor 22 and the second sub-conductor 23. The second feeding conductor 7 is in this way transformed from an unbalanced feed to a balanced feed.

According to an embodiment of the present invention, still referring to FIG. 1, the first sub-conductor 22 is then connected to a feeding side 25 of a first etched ridge structure 26, the ridge structure 26 having a stepped configuration facing away from the feeding side 25. In the same way, the second sub-conductor 23 is connected to a feeding side 27 of a second etched ridge structure 28. The second etched ridge structure 28 is a mirror image of the first etched ridge structure 26, mirrored in the symmetry line S, that passes between the etched ridge structures 26, 28 and is perpendicular to the extension of the feeding sides 25, 27, extending along the longitudinal extension of the dielectric carrier material 1. The etched ridge structures 26, 28 are thus symmetrical in appearance with reference to the symmetry line S. The symmetry line S passes a space 29 between the etched ridge structures.

Still referring to FIG. 1, the etched ridge structures 26, 28 transcend to the first ground plane 4, which first ground plane 4 circumvents the etched ridge structures 26, 28.

Still referring to FIG. 1, between the stepped configurations of the respective etched ridge structures 26, 28, the feeding pad 9 is positioned.

Now referring to FIG. 3, when the waveguide part 10 is mounted to the dielectric carrier material, the first feeding conductor 6 is arranged to excite a first polarization, where the electric field is perpendicular to the extension of the first main side 2, via the stepped structure 18 of the surface-mounted waveguide part 10. Furthermore, the second feeding conductor 7 is arranged to excite a second polarization, orthogonal to the first polarization, via the etched ridge structures 26, 28 on the dielectric carrier material 1.

Figure 4A:
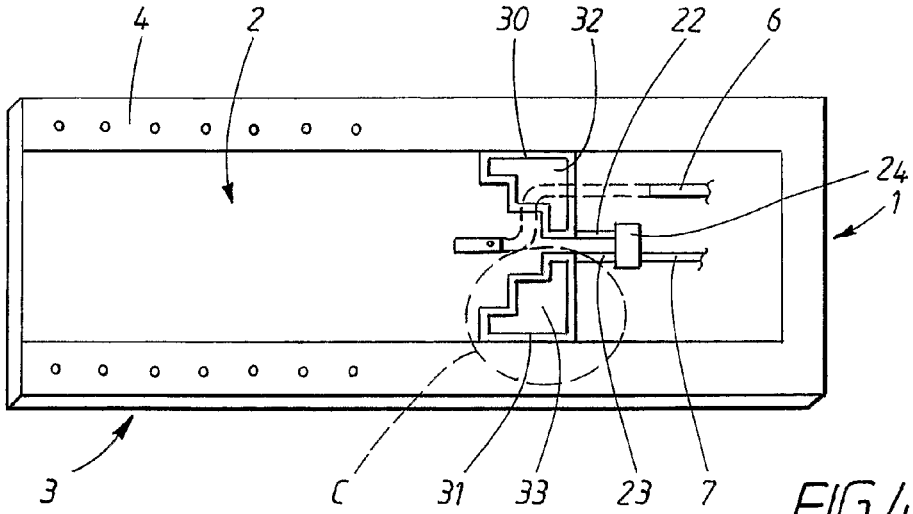
FIG. 4*a* shows a top view of a dielectric carrier material according to a second embodiment of the present invention.
Figure 4B:
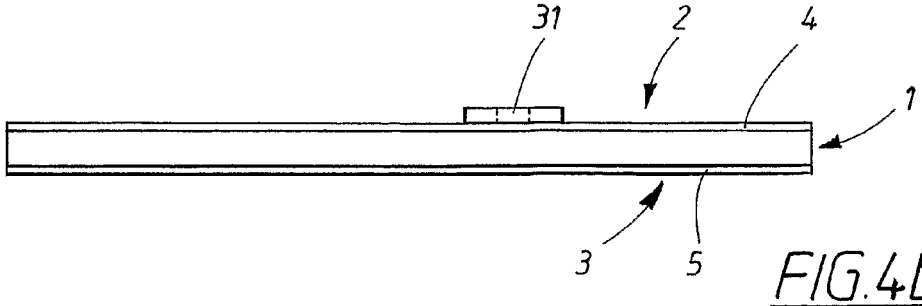
FIG. 4*b* shows a side view of a dielectric carrier material according to a second embodiment of the present invention.

In a second preferred embodiment, with reference to FIG. 4*a* and FIG. 4*b*, where FIG. 4*b* shows a side view of the top view in FIG. 4*a*, a first closed wall structure 30 (FIG. 4) and a second closed wall structure 31 is mounted on the dielectric carrier material 1, the walls extending perpendicular to the first main side 2. Each wall structure 30, 31 has an outer contour which corresponds to the outer contour of the etched ridge structures 26, 28 according to the first embodiment in FIG. 1. Each wall structure 30, 31 is soldered to the respective feeding sub-conductors 22, 23 (FIG. 4), such that the wall structures 30, 31 are fed in a similar way as the etched ridge structures, via the second feeding conductor 7 and the combined power divider and 180° phase shifter 24. Preferably, the wall structures 30, 31 are secured by means of pins (not shown) that are inserted into corresponding holes in the dielectric carrier material 1 and soldered. The walls have a certain height and a certain width, surrounding a respective inner space 32, 33. Generally, a better result is achieved the higher the wall is. The structure may have a roof, and may also be solid as well, having no inner space.

Figure 4C:
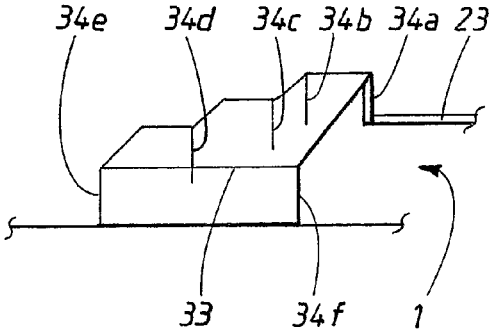
FIG. 4*c* shows a partial perspective view of FIG. 4*a;*

In a variety of the second preferred embodiment, with reference to FIG. 4*c*, roughly showing an enlarged perspective view of the area marked with the dashed circle C in FIG. 4*a*, each wall structure (one is shown in FIG. 4*b*) is in the form of a metal wire that is held at a certain distance from the dielectric carrier material 1, preferably in the middle of the vertical extension of the waveguide part 5 when it is mounted. Each metal wire is in the form of a closed structure, having an outer contour which corresponds to the outer contour of the etched ridge structures according to the first embodiment. Each wire is carried by means of pins 34*a*, 34*b*, 34*c*, 34*d*, 34*e*, 34*f* that are inserted into corresponding holes in the dielectric carrier material 1, where one pin 34*a* is large enough to be soldered to the respective feeding sub-conductor 23.

An alternative is that a roof structure (not shown) is held by means of pins in the same way as the wire.

The attachment of the structures shown above with reference to FIG. 4*a*, FIG. 4*b*, FIG. 4*c*, and FIG. 4*d* may be achieved as described, using pins that are inserted in holes in the dielectric carrier material 1 and soldered. It is also conceivable that the structures are surface-mounted, using suitable solderable pads formed on the first mains side 2.

Figure 4D:
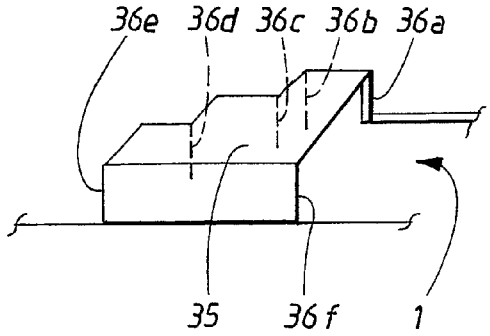
FIG. 4*d* shows the partial perspective view of FIG. 4*c*, showing a variety of the second embodiment of the present invention.

In another variety of the second preferred embodiment, with reference to FIG. 4*d*, roughly showing an enlarged perspective view of the area marked with the dashed circle C in FIG. 4*a*, a roof structure is used. The roof structure 35 has an outer contour which follows the outer contour which corresponds to the outer contour of the etched ridge structures according to the first embodiment. Each roof structure 35 is carried by means of pins 36*a*, 36*b*, 36*c*, 36*d*, 36*e*, 36*f* that are inserted into corresponding holes in the dielectric carrier material 1. One pin 36*a* is large enough to be soldered to the respective feeding sub-conductor 23 (FIG. 4*c*).

Figure 4E:
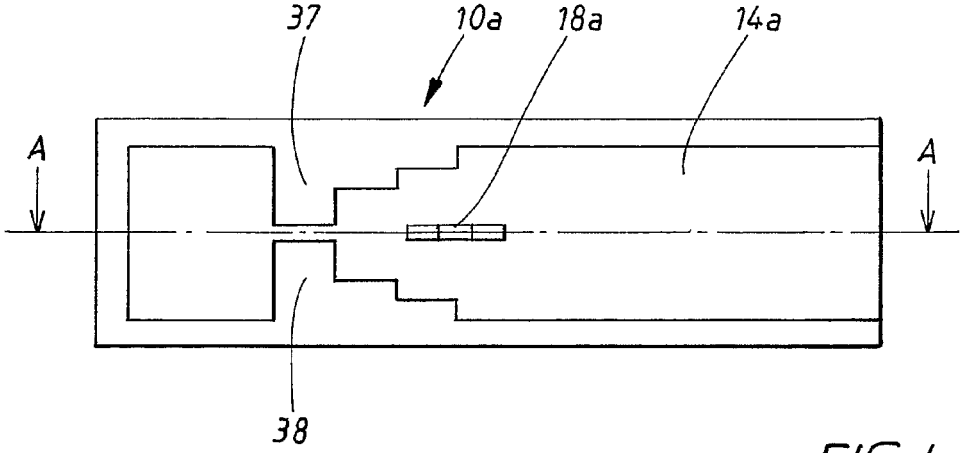
FIG. 4*e* shows a bottom view of a waveguide part according to a variety of the second embodiment of the present invention.
Figure 4F:
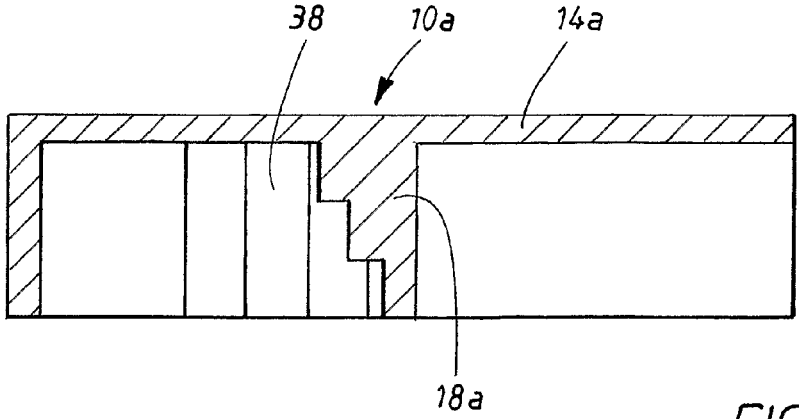
FIG. 4*f* shows a cross-section of FIG. 4*e;*

In yet another variety of the second preferred embodiment, with reference to FIGS. 4*e* and 4*f*, FIG. 4*f* showing a cross-section of FIG. 4*e*, wall structures 37 (FIG. 4*e*), 38 are shown, being a part of a waveguide part 10*a*, being formed integrally with the fourth wall 14*a* in the same way as the stepped structure 18*a*, having a height perpendicular to the main extension of the fourth wall 14*a*, where the height is adjusted in such a way that contact is established with the first sub-conductor and the second sub-conductor when the waveguide part 10*a* is mounted to the dielectric carrier (not shown). Contact is preferably made by means of soldering. The wall structures 37, 38 are in this case preferably made as a solid part, having no inner space.

In the second embodiment varieties as disclosed above with reference to the FIGS. 4*a*-4*f*, the etched ridge structure may be present on the dielectric carrier when the waveguide part is mounted to the dielectric carrier.

Figure 5A:
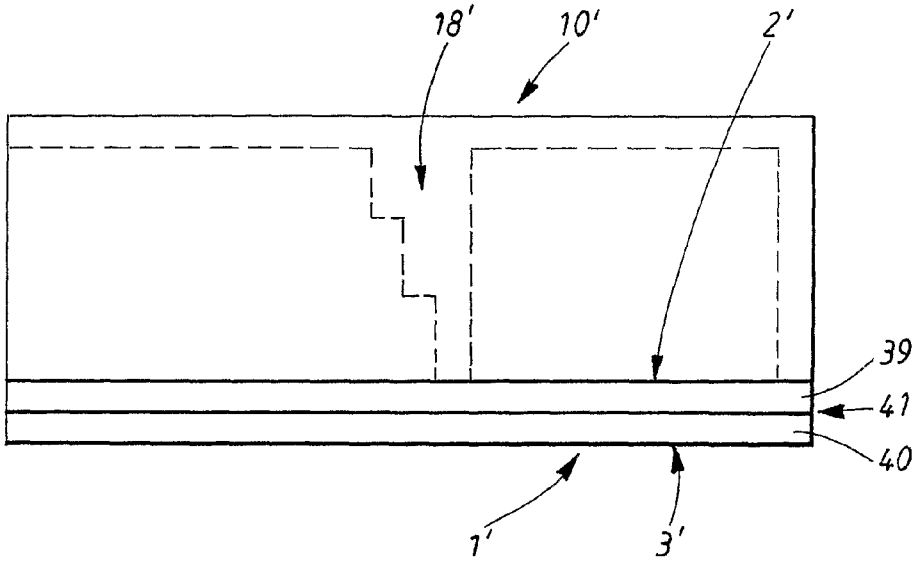
FIG. 5*a* shows a side view of a waveguide part mounted to a dielectric carrier material according to a third embodiment of the present invention.

A third embodiment is shown in FIG. 5*a*, where the etched ridge structures according to the first embodiment are utilized. The dielectric carrier material 1' is in the form of a multilayer carrier, comprising a first main side 2' (FIG. 5*a*) and a second main side 3' (FIG. 5*a*) as described for the first embodiment. Here, the first main side 2' is positioned on the outwardly facing side of a first dielectric layer 39, and the second main side 3' is positioned on the outwardly facing side of a second dielectric layer 40. Sandwiched between the first dielectric layer 39 and the second dielectric layer 40 there is an intermediate metalization 41, being of the same kind as the metalization on the first 2' and second 3' main sides. The intermediate metalization 41 (FIG. 5*a*) is originally fabricated on either the first dielectric layer 39 (FIG. 5*a*) or the second dielectric layer 40.

Figure 5B:
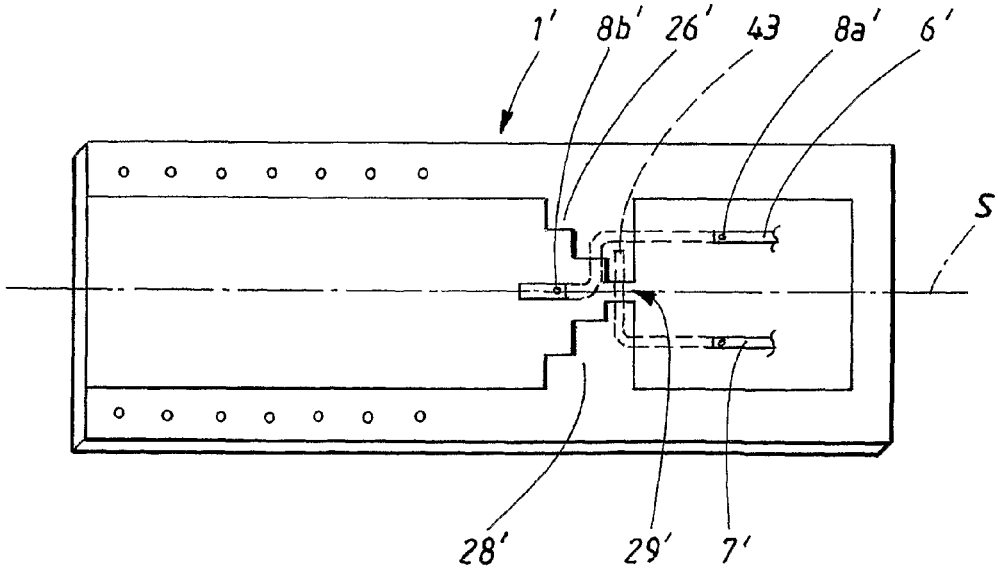
FIG. 5*b* shows a top view of a dielectric carrier material according to the third embodiment of the present invention.

The feeding of a stepped structure 18' in a surface-mounted waveguide part 10', similar to the surface-mounted waveguide part in the first embodiment, is carried out in a way similar to the feeding described for the first embodiment via a first feeding conductor as shown in FIG. 5*b*, showing a top view of the dielectric carrier material 1'. A first feeding conductor 6' runs on the first main layer 2' and on the second main layer 3' and passes through the intermediate metalization 41 when the first feeding conductor changes side by means of vias 8*a*', 8*b*'. The second feeding conductor 7' runs on the first main side 2' and then passes through the first dielectric layer 39 such that it runs via the intermediate metalization 41. The second feeding conductor 7' makes a turn when running via the intermediate metalization 41 in such a way that it runs perpendicular to a symmetry line S, passing a space 29' between etched ridge structures 26', 28'. After the passage, the second feeding conductor 7' ends in an open stub 43 at a certain appropriate distance from the passage, still running via the intermediate metalization 41, such that a good matching is achieved. This layout of the second feeding conductor thus feeds the etched ridge structures 26', 28' by means of coupling via the space 29' between the etched ridge structures 26', 28'.

The ridge structure may be formed in accordance with the embodiments described with reference to FIG. 4*a*, FIG. 4*b*, FIG. 4*c*, and FIG. 4*d*.

Figure 6A:
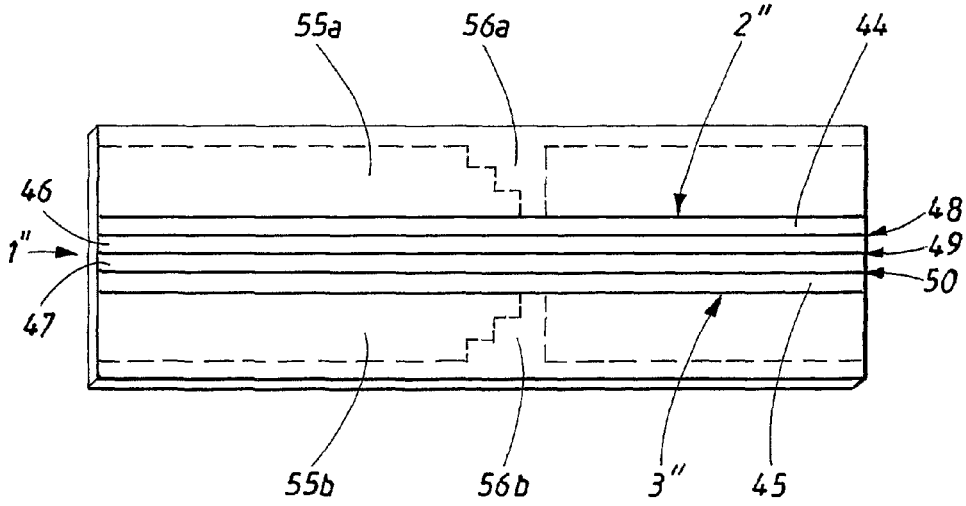
FIG. 6*a* shows a side view of two waveguide parts mounted to a dielectric carrier material according to a fourth embodiment of the present invention.
Figure 6B:
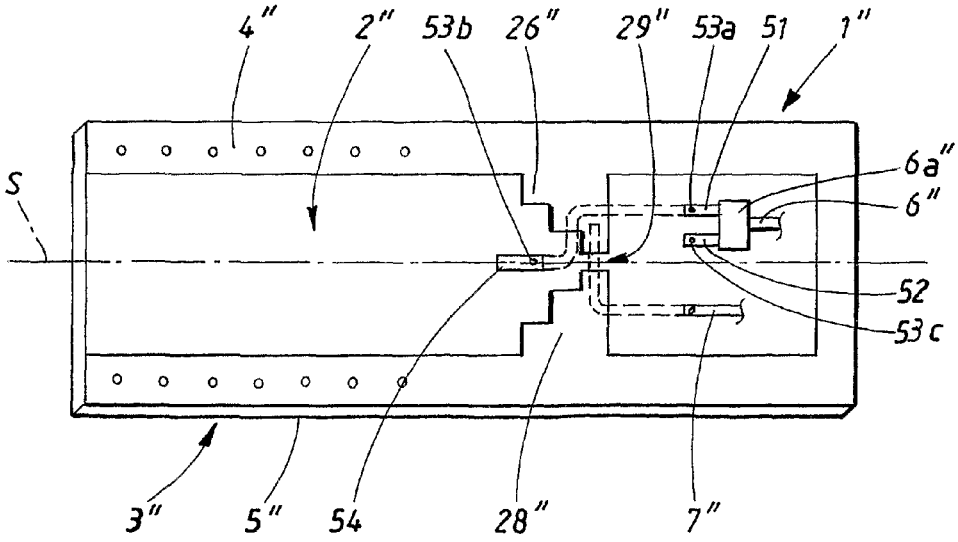
FIG. 6*b* shows a top view of a dielectric carrier material according to the fourth embodiment of the present invention.

A fourth embodiment is shown in FIG. 6*a*, where an enhanced symmetry is achieved. The dielectric carrier material 1" is in the form of a multilayer carrier, comprising a first main side 2" and a second main side 3" as described for the first embodiment, having respective metalizations 4", 5" (FIG. 6*b*). Here, the first main side 2" is positioned on the outwardly facing side of a first dielectric layer 44, and the second main side 3" is positioned on the outwardly facing side of a second dielectric layer 45. Sandwiched between the first dielectric layer 44 and the second dielectric layer 45, there is a third dielectric layer 46 and a fourth dielectric layer 47.

Between the first dielectric layer 44 and the third dielectric layer 46, there is a first intermediate metalization 48, between the third dielectric layer 46 and the fourth dielectric layer 47, there is a second intermediate metalization 49 (FIG. 6*a*), and between the fourth dielectric layer 47 and the second dielectric layer 45, there is a third intermediate metalization 50. All intermediate metalizations 48 (FIG. 6*a*), 49, 50 (FIG. 6*a*) are of the same kind as the metalization 4", 5" on the first 2" and second 3" main sides. The intermediate metalizations 48, 49, 50 are originally fabricated on either of the adjacent respective dielectric layers 44, 45, 46, 47. The dielectric layers 44, 45, 46, 47 are essentially of the same thickness.

On the first main side, as shown on FIG. 6*b*, showing a top view of the dielectric carrier material 1" without waveguide parts, a first pair of etched ridge structures 26", 28" according to the first embodiment is utilized, with a symmetry line S running in a space 29" between them. On the second main side 3" there is a second pair of etched ridge structures (not shown), the pairs being essentially identical and being positioned opposite to each other. Both pairs of etched ridge structures 26", 28" are fed by means of a second feeding conductor 7" running via the second intermediate metalization 49, where the feeding is achieved in the same manner as described for the third embodiment.

A first feeding conductor 6", running on the first main side 2", is divided into a first sub-conductor 51 and a second sub-conductor 52 by means of a power divider 6"*a* which also acts as a 180° phase shifter. The first feeding conductor 6" is thus divided equally between the first sub-conductor 51 and the second sub-conductor 52, where there a phase difference of 180° is introduced between the first sub-conductor 51 and the second sub-conductor 52.

The first sub-conductor 51 is transferred to the first intermediate metalization 48 by means of a via 53*a*, and ends in a first feeding pad 54 on the first main layer 2", being transferred back to the first main side by means of another via 53*b*.

The second sub-conductor 52 is transferred to the third intermediate metalization 50 by means of a via 53*c*, and ends in a second feeding pad on the second main layer 3", being transferred to the second main side by means of another via.

In FIG. 6*b*, the layout on the third intermediate metalization 50 and the second main layer 3" are not indicated since that would render FIG. 6*b* cluttered and difficult to use. These layouts are, however, not difficult to imagine since their appearance are reflected in the layout on the first intermediate metalization 48 and the first main layer 2".

As shown in FIG. 6*a*, first surface-mountable waveguide part 55*a* is mounted to the first main side 2" in the same way as the surface-mounted waveguide part used in the first embodiment, a first polarization being fed by the first sub-conductor 51, where contact is made between a stepped structure 56*a* of the first surface-mountable wave guide part 55*a* and the first feeding pad 54. Furthermore, a second surface-mountable waveguide part 55*b* is mounted to the second main side 2" in the same way as the first surface-mountable waveguide part 55*a* is mounted to the first main side 2", the first surface-mountable waveguide part 55*a* and second surface-mountable waveguide part 55*b* being mounted opposite to each other. A first polarization of the second surface-mountable waveguide part 5*b* is fed by the second sub-conductor 52, where contact is made between a stepped structure 56*b* of the second wave guide part 55*b* and the second feeding pad.

In this way, the first surface-mountable waveguide part 55*a* and the second surface-mountable waveguide part 55*b* together form a total waveguide part, where a symmetrical feeding of the first polarization is achieved. Furthermore, the second feeding conductor 7" feed both the first surface-mountable waveguide part 55*a* and the second surface-mountable waveguide part 55*b* by means of the opposite pairs of etched ridge structures 26", 28".

For this embodiment, there are a lot of variations. The feeding of the etched ridges 26", 28" may be performed in the same way as described for the first embodiment. A corresponding number of sub-conductors are then formed, using an appropriate number of dielectric layers with sandwiched metalizations.

Only one pair of etched ridge structures 26", 28" may be used, placed on either the first main side 2" or the second main side 3".

Since the stepped structures 56*a*, 56*b* of the waveguide parts 55*a*, 55*b* form a symmetrical feed, it is conceivable that only one etched ridge structure is used, since, according to the invention, at least one of the orthogonal feeds is symmetrical. In other words, only one etched ridge structure on either the first main side 2" or the second main side 3" will suffice, but the symmetry is slightly deteriorated by such a configuration.

All varieties of wall structures described in relation with the second embodiment are also applicable here, with or without etched ridge structures.

Figure 7A:
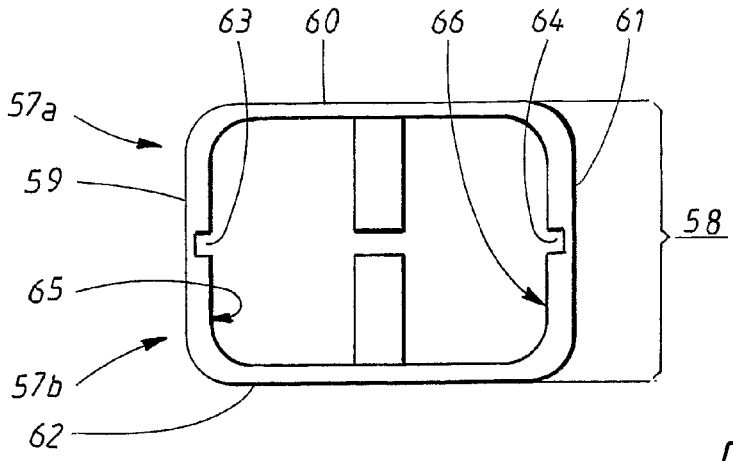
FIG. 7*a* shows a front view of an integral waveguide part according to a variety of the fourth embodiment of the present invention.

A special variety of the fourth embodiment is shown in FIG. 7*a*, where a first waveguide part 57*a* and a second waveguide part 57*b* are formed integrally, constituting an integral waveguide part 58. The integral waveguide part 58 has a first side 59, a second side 60, a third side 61 and a fourth side 62. The first side 59 the and third side 61 are opposite each other, and each one of these sides 59, 61 is supplied with a respective first longitudinal slot 63 and second longitudinal slot 64 (FIG. 7*a*) formed on the middle of the opposing surfaces 65, 66 of the first side 59 and the third side 61.

Figure 7B:
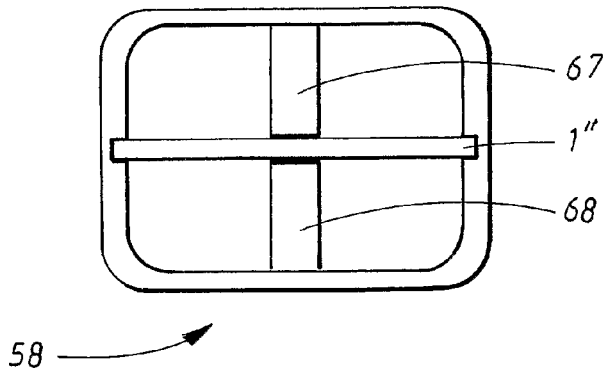
FIG. 7*b* shows the integral waveguide part of FIG. 7*a* with an inserted dielectric carrier material.

With reference to FIG. 7*b*, the dielectric carrier material 1", comprising a suitable number of dielectric layers (not shown), is inserted into these slots 63, 64 to a correct longitudinal position.

The first contact pad and second contact pad are then soldered to a respective stepped structure 67, 68. In this special variety, the integral waveguide part 58 is not surface-mounted, but constitutes a dual polarized waveguide, having a planar feed in the form of a planar dielectric carrier 1" with metalizations.

Figure 8:
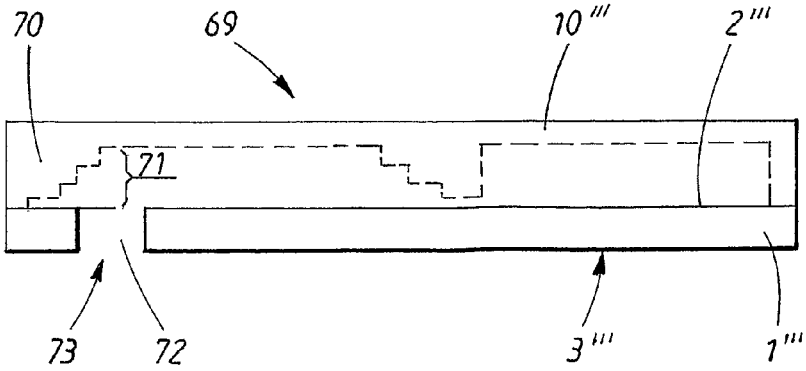
FIG. 8 shows an example of a waveguide part mounted to a dielectric carrier material, where a 90° bend is formed.

In FIG. 8, an example of an integral waveguide 69 with a 90° bend through the dielectric carrier material is shown. The integral waveguide 69 shown is of the same type as the one shown in FIG. 1, using a dielectric carrier material 1''' with a first main side 2''' and a second main side 3''' and a surface-mounted waveguide part 10''', but the principle may be used for all the first three embodiments. The open side in the first embodiment, shown in FIG. 1, is here substituted by a 90° bend 70 through the dielectric carrier material 1'''.

The bend 70 is traditional in its design, utilizing a stepped structure 71 that extends across the width of the waveguide part 10'''. Immediately after the bend, there is an opening 72 in the dielectric carrier material 1''', continuing the extension of the now re-directed waveguide. On the second main side 3''' of the dielectric carrier material 1''', a waveguide opening 73 is formed, which opening may serve as a waveguide flange for mounting of a continuing waveguide or a radiating element, alternatively, the opening serves as an radiating element itself.

Figure 9A:
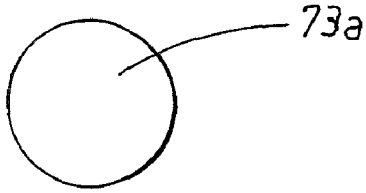
FIG. 9*a* shows a first example of an opening in the dielectric carrier material for the 90° bend.
Figure 9B:
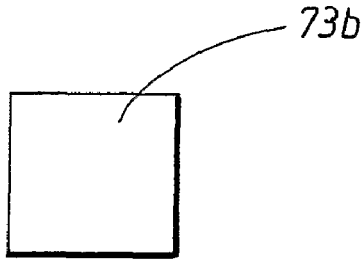
FIG. 9*b* shows a second example of an opening in the dielectric carrier material for the 90° bend.
Figure 9C:
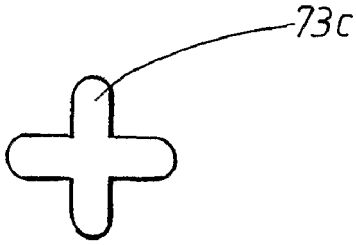
FIG. 9*c* shows a third example of an opening in the dielectric carrier material for the 90° bend.

As shown in FIG. 9*a* and FIG. 9*b*, the opening 73*a* (FIG. 9*a*), 73*b* (FIG. 9*b*) may have a circular shape and a square shape. As shown in FIG. 9*c*, the opening 73*c* may also be cross-shaped. Other shapes are of course conceivable.

Many other embodiment examples of dual polarized waveguides using the planar feed of the present invention are of course conceivable, the ones shown are only examples.

The present invention is not limited to the embodiments shown, but may vary freely within the scope of the appended claims.

For example, the metalization may be of any suitable metal, and may be in the form of separate metal sheets or pieces.

The open part of the integral waveguides above may continue into a traditional waveguide, or may end as a radiating element.

Other fastening methods than soldering are conceivable, for example the use of conductive adhesive.

The number of dielectric layers and metalizations may vary depending on how the feeding conductors used are routed. For example, for the first embodiment, the dielectric carrier material may comprise two dielectric layers between which a metalization is sandwiched. The ground plane on the second main side is in this case complete, having no etched conductors. The first feeding conductor is instead routed by means of the sandwiched metalization.

The thicknesses of the dielectric layers are preferably essentially equal, but may of course vary.

The combined power dividers and 180° phase shifters that have been described can either be in the form of discrete components, or in the form of etched conductors, for example a power divider of a Wilkinson type and 180° extra length added to one of the sub-conductors. A combination of both is of course also conceivable.

The opening in the dielectric carrier material following a 90° bend, may be formed in such a way that the copper cladding is etched away at the place of the opening, but the dielectric material itself remains.

The feeding tabs have been described to be placed on the side of the etched ridge structure that faces away from the feeding, but may just as well be placed on the other side of the etched ridge structure, on the same side as the feeding sides 25, 27 shown in FIG. 1. In some cases, this latter placing may preferable to the former placing.

The orthogonal polarization may be fed in such a way that circular or elliptical polarization is obtained.

The symmetry line S does not designate a complete symmetry of the dielectric carrier; the feeding conductors are for example not symmetrical with respect to the symmetry line S. The symmetry line S has a primary function to define the symmetry of the etched ridge structures.

The number of steps applied for the stepped structure on the waveguide parts, the etched ridge structure and wall structure may vary in such a way that a desired performance is achieved.

All stepped structures and etched ridges, being described to comprise discrete steps, may also be formed continuously instead, generally constituting excitation means.

The first ground plane 4 may cover more of the first main side 2.

The stepped structures and ridge structures constitute excitation means.

The waveguide arrangement according to the present invention has a longitudinal extension, along which an electromagnetic wave may propagate.

The invention claimed is:

1. A waveguide arrangement having a longitudinal extension, along which an electromagnetic wave may propagate, comprising:

at least one waveguide part and a feeding arrangement, where the feeding arrangement is arranged for feeding said waveguide part with a first polarization and a second polarization, said polarizations being mutually orthogonal;

the feeding arrangement further comprising a dielectric carrier material having a first main side and a second main side with metallization patterns formed on said first and second main side, wherein the metallization patterns further comprise a first feeding conductor, feeding the first polarization, and a second feeding conductor, feeding the second polarization, wherein the first polarization is excited by means of first excitation means fed by said first feeding conductor, and the second polarization is excited by means of second excitation means fed by said second feeding conductor, wherein the second excitation means comprises at least one pair of tapered structures which extend in the longitudinal extension, each tapered structure among the at least one pair of tapered structures being essentially orthogonal to a taper of the first excitation means where the each tapered structure among the at least one pair of tapered structures is symmetrical with respect to a symmetry line that extends in the longitudinal extension and equally divides the first main side of the dielectric carrier material into two parts, the each tapered structure among the at least one pair of tapered structures being placed opposite each other, each tapered structure being directed away from the feeding arrangement.

2. The waveguide arrangement according to claim 1, wherein each one of said tapered structures comprises a metal wire that is held at a certain distance from the dielectric carrier material, said metal wire being in the form of a closed structure, having an outer contour which corresponds to said each one of said tapered structures, the metal wire being fed by the second feeding conductor.

3. The waveguide arrangement according to claim 1, wherein the second excitation means is fed by the second feeding conductor by means of electromagnetic coupling.

4. The waveguide arrangement according to claim 1, wherein the second excitation means is directly connected to the second feeding conductor.

5. The waveguide arrangement according to claim 1, wherein said at least one pair of tapered structures comprise one pair of tapered structures positioned on the first main side.

6. The waveguide arrangement according to claim 1, wherein said tapered structures among the at least one pair of tapered structures are made as etched structures being connected to a surrounding ground plane structure, both said tapered structures among the at least one part of tapered structures being a part of the metallization pattern on the first main side which are etched structures that extend in the longitudinal extension and taper towards the surrounding ground plane structure.

7. The waveguide arrangement according to claim 1, wherein the second excitation means comprises at least a first wall structure and a second wall structure extending perpendicular to the first main side, wherein each wall structure has an outer contour which corresponds to a tapered structure among the at least one pair of tapered structures, each wall structure being fed by the second feeding conductor.

8. The waveguide arrangement according to claim 7, wherein each wall structure surrounds an inner space.

9. The waveguide arrangement according to claim 7, wherein each wall structure is formed integrally with at least a first waveguide part.

10. The waveguide arrangement according to claim 1, wherein the first excitation means essentially has the same width as the first feeding conductor.

11. A waveguide arrangement according to claim 1, further comprising:

a first waveguide part, said first waveguide part further comprises:
- a first wall;
- a second wall;
- a third wall;
- a fourth wall, and
- a longitudinal opening, wherein the first wall, the second wall, and the third wall essentially form a U-formed wall structure, wherein the fourth wall constitutes a roof on the top of the first wall, the second wall, and the third wall, electrically coupling the first to fourth walls, wherein the roof is essentially parallel to, and facing away from, the dielectric carrier material, when said waveguide part is mounted to the dielectric carrier material, wherein furthermore said first excitation means comprises a first structure that extends from the fourth wall and also extends in the longitudinal extension, where the first structure tapers towards the first feeding conductor, orthogonal to the first main side, and makes electrical contact with the first feeding conductor.

12. The waveguide arrangement according to claim 11, further comprising:

a second waveguide, wherein the first waveguide part and the second waveguide part are positioned opposite each other in such a way that they together form a total waveguide part with the dielectric carrier material positioned between said waveguide parts, and wherein said first excitation means also comprises a second structure which extends from the second waveguide part, and extends longitudinally, orthogonal to the first main side, wherein the second structure extends towards the first feeding conductor, and makes electrical contact with the first feeding conductor.

13. The waveguide arrangement according to claim 12, wherein the first waveguide part and the second waveguide part are formed integrally, constituting an integral waveguide part having a first side, a second side, a third side, and a fourth side wherein the first side and the third side are opposite each other, and each one of the first and third sides is supplied with a respective first longitudinal slot and second longitudinal slot formed on the middle of the opposing surfaces of the first side and the third side, the slots being arranged for insertion of the dielectric carrier material.

* * * * *